US010444664B2

(12) United States Patent
Oshikawa

(10) Patent No.: US 10,444,664 B2
(45) Date of Patent: Oct. 15, 2019

(54) CONVEYING DEVICE AND IMAGE FORMING APPARATUS INCORPORATING THE CONVEYING DEVICE

(71) Applicant: Yuki Oshikawa, Kanagawa (JP)

(72) Inventor: Yuki Oshikawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/019,896

(22) Filed: Jun. 27, 2018

(65) Prior Publication Data

US 2019/0018343 A1 Jan. 17, 2019

(30) Foreign Application Priority Data

Jul. 11, 2017 (JP) ..... 2017-135752

(51) Int. Cl.
*G03G 15/08* (2006.01)

(52) U.S. Cl.
CPC ..... *G03G 15/0865* (2013.01); *G03G 15/0879* (2013.01); *G03G 15/0891* (2013.01)

(58) Field of Classification Search
CPC ..... G03G 15/0865; G03G 15/0879; G03G 15/0891
See application file for complete search history.

(56) References Cited

U.S. PATENT DOCUMENTS 9,465,320 B1 * 10/2016 Kim ..... G03G 15/0879
2008/0253810 A1 10/2008 Tateyama et al.
2008/0260431 A1 * 10/2008 Saito ..... G03G 15/0879 399/256
2008/0279594 A1 * 11/2008 Sakoh ..... G03G 15/0875 399/262
2008/0286012 A1 * 11/2008 Saito ..... G03G 15/0875 399/258
2008/0310865 A1 12/2008 Uno et al.
2009/0041508 A1 2/2009 Oshikawa et al.
2009/0087214 A1 4/2009 Utsunomiya et al.
2009/0103935 A1 4/2009 Uno et al.
2009/0110425 A1 4/2009 Uno et al.
(Continued)

FOREIGN PATENT DOCUMENTS

JP 2008-286861 11/2008
JP 2012-047784 3/2012

*Primary Examiner* — Rodney A Bonnette
(74) *Attorney, Agent, or Firm* — Harness, Dickey & Pierce, P.L.C.

(57) ABSTRACT

A conveying device, which is included in an image forming apparatus, includes a conveying body, a conveyance passage, and an inlet portion. The conveying body has an elastic material and is configured to convey one of toner and developer. The conveyance passage includes the conveying body therein. The one of toner and developer is conveyed to the conveyance passage in a conveying direction as the conveying body rotates. The inlet portion is formed at an upstream side of the conveyance passage and is configured to pass the one of toner and developer therethrough into the conveyance passage. The conveying body has an exposed portion exposed through the inlet portion being exposed inside the conveyance passage. A portion of the exposed portion of the conveying body includes a high rigidity portion having rigidity greater than rigidity of a non high rigidity portion of the conveying body.

17 Claims, 4 Drawing Sheets

(56) References Cited

U.S. PATENT DOCUMENTS

| | | | | |
|---|---|---|---|---|
| 2009/0263164 | A1 | 10/2009 | Koeda et al. | |
| 2011/0064474 | A1* | 3/2011 | Funada ..... | G03G 15/0879 399/258 |
| 2011/0243579 | A1 | 10/2011 | Oshikawa et al. | |
| 2011/0305485 | A1 | 12/2011 | Oshikawa et al. | |
| 2012/0230738 | A1 | 9/2012 | Yoshizawa et al. | |
| 2012/0237249 | A1 | 9/2012 | Utsunomiya et al. | |
| 2012/0269544 | A1 | 10/2012 | Tsuda et al. | |
| 2012/0269553 | A1 | 10/2012 | Yoshizawa et al. | |
| 2014/0029973 | A1 | 1/2014 | Terazawa et al. | |
| 2014/0169827 | A1 | 6/2014 | Hattori et al. | |
| 2014/0248060 | A1 | 9/2014 | Oshikawa et al. | |
| 2014/0270838 | A1 | 9/2014 | Yoshizawa et al. | |
| 2015/0362861 | A1 | 12/2015 | Oshikawa et al. | |
| 2016/0238966 | A1 | 8/2016 | Oshikawa et al. | |
| 2017/0108795 | A1 | 4/2017 | Oshikawa et al. | |

* cited by examiner

CONVEYING DEVICE AND IMAGE FORMING APPARATUS INCORPORATING THE CONVEYING DEVICE

CROSS-REFERENCE TO RELATED APPLICATION

This patent application is based on and claims priority pursuant to 35 U.S.C. § 119(a) to Japanese Patent Application No. 2017-135752, filed on Jul. 11, 2017, in the Japan Patent Office, the entire disclosure of which is hereby incorporated by reference herein.

BACKGROUND

Technical Field

This disclosure relates to a conveying device that conveys toner and developer, and an image forming apparatus such as a copier, printer, facsimile machine, a multi-functional apparatus including at least two functions of the copier, printer, and facsimile machine.

Related Art

Image forming apparatuses such as copiers and printers provided with a conveying device to convey toner or developer are widely known.

To be specific, a known conveying device (e.g., a toner hopper) includes a conveyance screw, a conveyance passage with a conveyance screw therein (e.g., a toner conveyance pipe) and so forth. In the conveyance passage, toner is conveyed in a predetermined direction by a conveyance screw that is driven and rotated by a drive device. When the toner is conveyed out from an outlet portion (an opening) is supplied to a developing device.

SUMMARY

At least one aspect of this disclosure provides a conveying device including a conveying body, a conveyance passage, and an inlet portion. The conveying body has an elastic material and is configured to convey one of toner and developer. The conveyance passage includes the conveying body therein. The one of toner and developer is conveyed to the conveyance passage in a conveying direction as the conveying body rotates. The inlet portion is formed at an upstream side of the conveyance passage and is configured to pass the one of toner and developer therethrough into the conveyance passage. The conveying body has an exposed portion exposed through the inlet portion being exposed inside the conveyance passage. A portion of the exposed portion of the conveying body includes a high rigidity portion having rigidity greater than rigidity of a non high rigidity portion of the conveying body.

Further, at least one aspect of this disclosure provides an image forming apparatus including the above-described conveying device.

Further, at least one aspect of this disclosure provides a conveying device including a conveying screw, a conveyance passage and an inlet portion. The conveying screw has an elastic material and configured to convey one of toner and developer. The conveyance passage includes the conveying screw therein and to which the one of toner and developer is conveyed in a conveying direction as the conveying screw rotates. The inlet portion is formed at an upstream side of the conveyance passage and is configured to pass the one of toner and developer therethrough into the conveyance passage. The conveying screw includes a screw portion and a shaft around which the screw portion is wound in a spiral. The conveying screw has a first shaft portion and a second shaft portion. An outer diameter of the first shaft portion of the conveying screw is greater than an outer diameter of the second shaft portion of the conveying screw. A screw diameter of the screw portion of the first shaft portion of the conveying screw is equal to a screw diameter of the second shaft portion of the conveying screw.

Further, at least one aspect of this disclosure provides an image forming apparatus including the above-described conveying device.

BRIEF DESCRIPTION OF THE SEVERAL VIEWS OF THE DRAWINGS

An exemplary embodiment of this disclosure will be described in detail based on the following figured, wherein.

Figure 1:
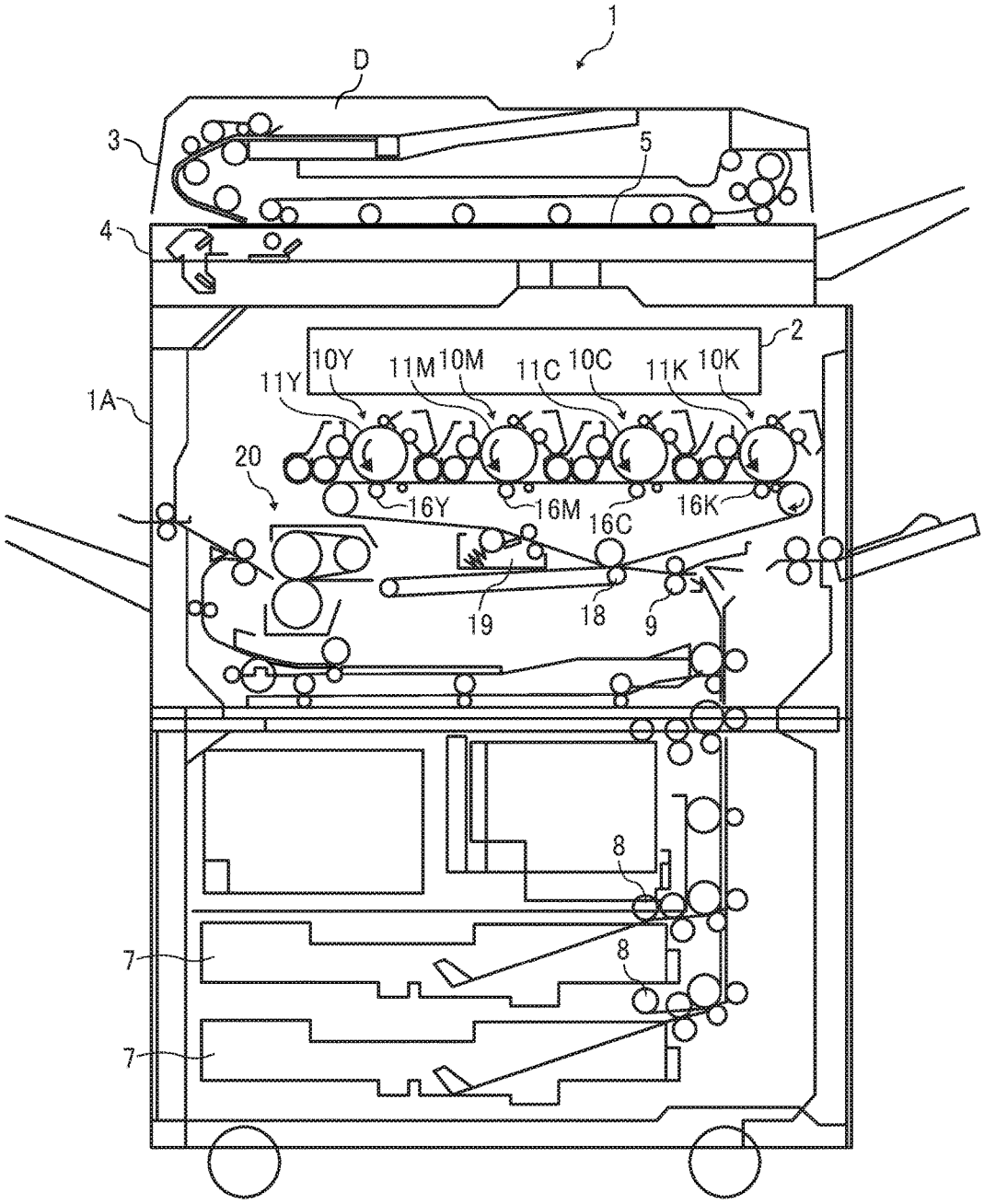
FIG. 1 is a diagram illustrating an overall configuration of an image forming apparatus according to an embodiment of this disclosure.

The accompanying drawings are intended to depict embodiments of this disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the teen "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Next, a description is given of a configuration and functions of an image forming apparatus according to an embodiment of this disclosure, with reference to drawings.

It is to be noted that elements (for example, mechanical parts and components) having the same functions and shapes are denoted by the same reference numerals throughout the specification and redundant descriptions are summarized or omitted accordingly.

Figure 2:
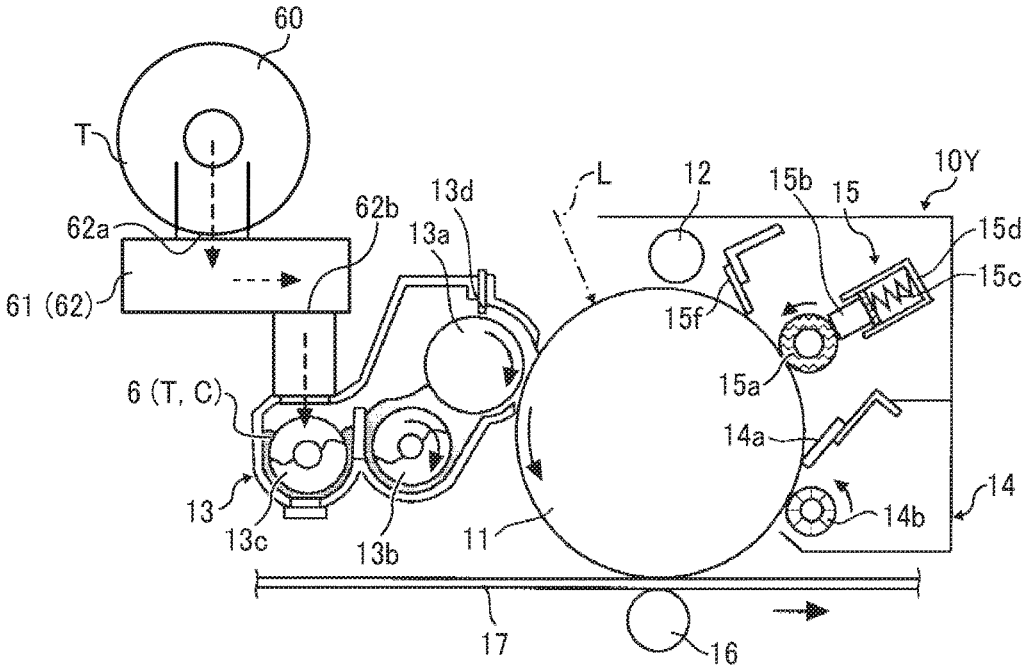
FIG. 2 is a diagram illustrating a process cartridge and units and components disposed near the process cartridge.

Now, a description is given of an overall configuration and functions of the image forming apparatus 1 with reference to FIGS. 1 and 2.

FIG. 1 is a diagram illustrating an overall configuration of the image forming apparatus 1 according to an embodiment of this disclosure. FIG. 2 is a cross sectional view illustrating a process cartridge 10 for forming a single color image of any one of yellow, magenta, cyan, and black images, included in the image forming apparatus 1 of FIG. 1.

It is to be noted that four process cartridges 10Y, 10M, 10C, and 10K basically have an identical configuration to each other, except that the colors of respective toners T used form image forming processes are different, which are yellow (Y), magenta (M), cyan (C), and black (K). Therefore, the following description is given with reference numeral "10" without any suffix, Y, C, and K, but is applied to any one of the process cartridges 10Y, 10M, 10C, and 10K.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 1 includes an optical writing device 2, a document feeding device 3, a document reading device 4, sheet feeding devices 7, sheet feed rollers 8, a pair of registration rollers 9, the process cartridges 10Y, 10M, 10C and 10K, photoconductor drums 11Y, 11M, 11C and 11K, primary transfer bias rollers 16Y, 16M, 16C and 16K, an intermediate transfer belt 17, a secondary transfer bias roller 18, an intermediate transfer belt cleaning device 19 and a fixing device 20.

The image forming apparatus 1 is a tandem-type color copier. The optical writing device 2 emits an exposure light L based on the image data read by the document reading device 4 to irradiate the exposure light L onto a surface of each photoconductor drum 11 (i.e., photoconductor drums 11Y, 11M, 11C and 11K) that functions as an image bearer. The document feeding device 3 conveys an original document D to the document reading device 4. The document reading device 4 reads the image data of the original document D. The sheet feeding devices 7 in each of which sheets are stored. The pair of registration rollers 9 adjusts a conveyance time of the sheet.

The process cartridges 10Y, 10M, 10C, and 10K form respective (yellow, magenta, cyan and black) toner images on respective surfaces of the photoconductor drums 11Y, 11M, 11C and 11K, The respective primary transfer bias rollers 16Y, 16M, 16C and 16K transfer the respective toner images to be overlaid sequentially onto a surface of the intermediate transfer belt 17 to form a composite color toner image.

The intermediate transfer belt 17 bears the composite color toner image transferred thereon. The secondary transfer bias roller 18 transfers the composite color toner image formed on the surface of the intermediate transfer belt 17 onto a sheet. The intermediate transfer belt cleaning device 19 cleans the intermediate transfer belt 17. The fixing device 20 fixes the composite color toner image (an unfixed image) formed on the sheet to the sheet.

Now, a description is given of regular color image forming operations performed by the image forming apparatus 1.

The original document D is fed from a document loading table provided to the document feeding device 3 and conveyed by multiple pairs of sheet conveying rollers disposed in the document feeding device 3 in a direction indicated by arrow in FIG. 1, to the exposure glass 5 provided to the document reading device 4. The document reading device 4 optically reads image data of the original document D placed on the exposure glass 5.

Consequently, each color data of yellow, magenta, cyan, and black is transmitted to the optical writing device 2. Then, the optical writing device 2 emits laser light beams (exposure light) L based on the image data of the electrical image signals toward the surface of the photoconductor drum 11 (i.e., an image bearer) of the process cartridge 10 (i.e., the process cartridges 10Y, 10M, 10C, and 10K).

By contrast, the photoconductor drum 11 (i.e., the photoconductor drums 11Y, 11M, 11C and 11K) of the process cartridge 10 (i.e., the process cartridges 10Y, 10M, 10C, and 10K) rotates in a predetermined direction as illustrated in FIG. 2 (i.e., a counterclockwise direction in FIG. 2). As the photoconductor drum 11 rotates, the charging roller 12 uniformly charges a surface of the photoconductor drum 11 at a position facing each other. (This is a charging process.) As a result, a charging potential is formed on the surface of the photoconductor drum 11. In the present embodiment, the charging potential on the photoconductor drum 11 is around −900V. Then, as the photoconductor drum 11 is rotated, the charged surface of the photoconductor drum 11 is brought to a light emitting position of each of the laser light beams L.

In the optical writing device 2, four laser light beams L corresponding to respective color image data are emitted from four light sources of different colors. The optical writing device 2 emits the laser light beams L according to image data. The four laser light beams L pass through respective optical paths for yellow, magenta, cyan, and black. (This is an exposure process.)

The laser light beam L corresponding to the yellow component is emitted to the surface of the first photoconductor drum 11 from the left of FIG. 1, that is, to the surface of the photoconductor drum 11Y in the present embodiment. At this time, a polygon mirror rotates at high speed to deflect the laser light beam L having the yellow component in a direction of rotational axis of the photoconductor drum 11 (i.e., a main scanning direction) so as to scan the photoconductor drum 11. According to this operation, after the surface of the photoconductor drum 11Y is charged by the charging roller 12, an electrostatic latent image having the yellow component is formed on the surface of the photoconductor drum Y.

Similarly, the laser light beam L corresponding to the magenta component is emitted to the surface of the second photoconductor drum 11 from the left of FIG. 1, that is, to the surface of the photoconductor drum 11M in the present embodiment. Consequently, an electrostatic latent image having the magenta component is formed on the surface of the photoconductor drum 11M. The laser light beam L corresponding to the cyan component is emitted to the surface of the third photoconductor drum 11 from the left of FIG. 1, that is, to the surface of the photoconductor drum 11C in the present embodiment. Consequently, an electrostatic latent image having the cyan component is formed on the surface of the photoconductor drum 11C. The laser light beam L corresponding to the black component is emitted to the surface of the fourth photoconductor drum 11 from the left of FIG. 1, that is, to the surface of the photoconductor drum 11K in the present embodiment. Consequently, an electrostatic latent image having the black component is formed on the surface of the photoconductor drum 11K.

Then, the respective surfaces of the photoconductor drums 11Y 11M, 11C, and 11K having the respective electrostatic latent images having the yellow, magenta, cyan, and black components, respectively, come to respective opposing positions to a developing roller 13*a* of each of developing devices 13Y, 13M, 13C, and 13K. The developing device 13 (i.e., the developing devices 13Y, 13M, 13C, and 13K) supplies toner onto the surface of the photoconductor drum 11 (i.e., the photoconductor drums 11Y 11M, 11C, and 11K), so that the electrostatic latent image formed on the surface of the photoconductor drum 11 is developed into a visible toner image. (This is a developing process.)

Thereafter, the respective surfaces of the photoconductor drums 11Y, 11M, 11C, and 11K come to respective opposing positions to the intermediate transfer belt 17. The primary transfer bias rollers 16Y, 16M, 16C, and 16K are disposed at the respective opposing positions of the photoconductor drums 11Y, 11M, 11C, and 11K to the intermediate transfer belt 17. The primary transfer bias rollers 16Y, 16M, 16C, and 16K are disposed in contact with an inner circumferential surface of the loop of the intermediate transfer belt 17. Then, respective single color toner images formed on the surfaces of the photoconductor drums 11Y, 11M, 11C, and 11K are sequentially transferred and overlaid onto the intermediate transfer belt 17 at the positions of the primary transfer bias rollers 16Y, 16M, 16C, and 16K. (This is a primary transfer process.)

After the primary transfer process, the surface of the photoconductor drum 11 (i.e., the photoconductor drums 11Y, 11M, 11C and 11K) comes to an opposing position of a cleaning device 14. At this position, untransferred toner remaining on the surface of the photoconductor drum 11 is mechanically removed by a cleaning blade 14*a* and a cleaning brush roller 14*b*. The removed untransferred toner is collected into the cleaning device 14. (This is a cleaning process.) The untransferred toner collected in the cleaning device 14 is conveyed toward an inlet port of a waste toner collecting device at a predetermined time so as to be collected into the waste toner collecting device.

Thereafter, the surface of the photoconductor drum 11 passes a lubricating device and an electric discharging device. After these processes, a series of image forming processes of the photoconductor drum 11 is completed.

The composite color toner image is formed on the intermediate transfer belt 17 by transferring and overlaying the respective single color toner images formed on the photoconductor drums 11Y, 11M, 11C, and 11K. Then, the intermediate transfer belt 17 moves in a clockwise direction in FIG. 1 to come to an opposing position to the secondary transfer bias roller 18. Then, the composite color toner image formed and borne on the intermediate transfer belt 17 is transferred onto a sheet (a recording medium) at the opposing position of the secondary transfer bias roller 18. (This is a secondary transfer process.)

After the secondary transfer process, the surface of the intermediate transfer belt 17 comes to an opposing position to the intermediate transfer belt cleaning device 19. Consequently, foreign material such as untransferred toner remaining on the surface of the intermediate transfer belt 17 is removed and collected by the intermediate transfer belt cleaning device 19. After these processes, a series of image forming processes of the intermediate transfer belt 17 is completed.

The sheet P that has been conveyed in a secondary transfer nip region formed between the intermediate transfer belt 17 and the secondary transfer bias roller 18 is conveyed via conveyance components from a selected one of the sheet feeding devices 7 to the pair of registration rollers 9.

To be more specific, after being conveyed by each sheet feed roller 8 of a selected one of the sheet feeding devices 7 in which multiple sheets including the sheet are stored, the sheet passes through a sheet conveyance guide to be guided to the pair of registration rollers 9 (i.e., a pair of timing rollers). The sheet that has reached the pair of registration rollers 9 is conveyed toward the secondary transfer nip region at a predetermined time.

Consequently, the sheet having a full color image thereon is guided by a conveyance belt to the fixing device 20. The fixing device 20 fixes the composite color toner image (toner) formed on the sheet to the sheet at a fixing nip region by application of heat applied by a fixing belt and pressure applied by a pressure roller.

After this fixing process, the sheet is ejected by a sheet ejecting roller to an outside of an apparatus body 1A of the image forming apparatus 1, as an output image. Accordingly, a series of image forming processes is completed.

Figure 3:
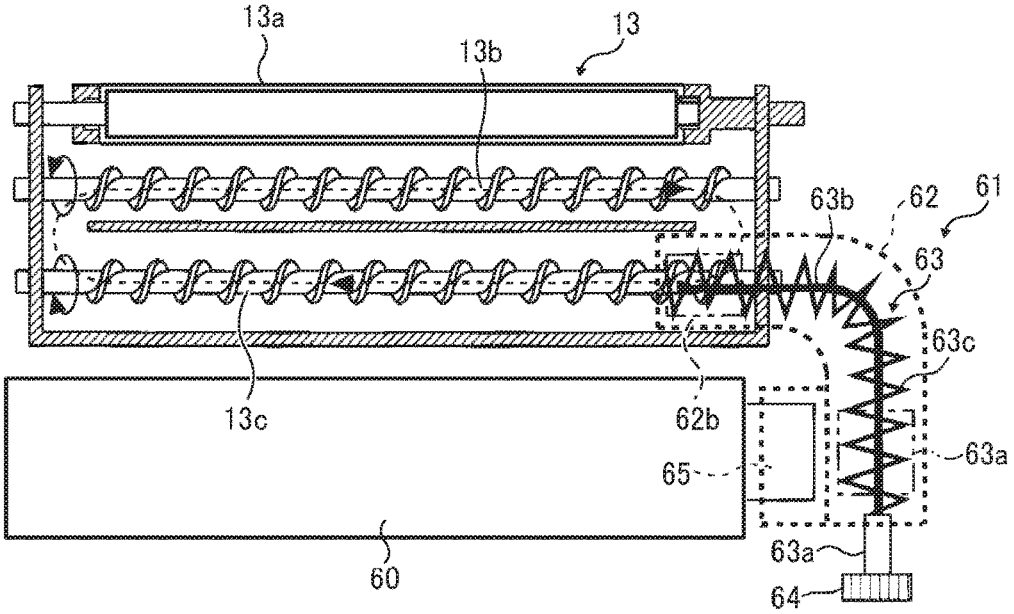
FIG. 3 is a diagram illustrating a toner container, a toner hopper and a developing device, viewed along a longitudinal direction thereof.

As described above, FIG. 2 is a diagram illustrating the process cartridge 10 and units and components disposed near the process cartridge 10. FIG. 3 is a diagram illustrating a toner container 60, a toner hopper 61 and the developing device 13, viewed along a longitudinal direction thereof.

As illustrated in FIG. 2, the process cartridge 10 includes the photoconductor drum 11, the charging roller 12 that functions as a charging device, the developing device 13, the cleaning device 14 and the lubricating device 15 as a single unit. The process cartridge 10 is detachably (replaceably) attached to the apparatus body 1A of the image forming apparatus 1. The process cartridge 10 is removed from the apparatus body 1A of the image forming apparatus 1 occasionally to be replaced to a new process cartridge having the same configuration as the process cartridge 10 or to be repaired.

Here, the photoconductor drum 11 that functions as an image bearer is an organic photoconductor charged to a negative polarity. The photoconductor drum 11 includes a conductive layer overlaying a drum-shaped conductive support body.

The photoconductor drum 11 includes multiple layers including the conductive support body that functions as a base layer, an undercoat layer that functions as an insulation layer, a charge generation layer and a charge transport layer that function as a photoconductive layer, and a surface layer (i.e., a protection layer). The undercoat layer is overlaid on the photoconductive support body, the charge generation layer and the charge transport layer are overlaid on the undercoat layer, and the surface layer is formed on top of the charge generation layer and the charge transport layer.

A main motor drives to rotate the photoconductor drum 11 in a counterclockwise direction in FIG. 2.

With reference to FIG. 2, the charging roller 12 includes a conductive cored bar and an elastic layer of moderate resistivity covering an outer circumference of the conductive cored bar. The charging roller 12 is disposed to a position opposed to the photoconductor drum 11 with a slight gap therebetween. As the photoconductor drum 11 rotates, the charging roller 12 applies a predetermined voltage (a charging bias) from a charging power source to uniformly charge a surface of the photoconductor drum 11 at a position facing each other.

The developing device 13 includes a developing roller 13*a*, a first conveying screw 13*b*, a second conveying screw 13*c*, and a doctor blade 13*d*. The developing roller 13*a* is disposed facing the photoconductor drum 11. The first conveying screw 13*b* is disposed facing the developing roller 13*a*. The second conveying screw 13*c* is disposed facing the first conveying screw 13*b* via a partition. The doctor blade 13*d* is disposed facing the developing roller 13*a*. The developing roller 13*a* includes magnet and a sleeve. The magnet includes a magnet roller or multiple magnets fixedly disposed inside the developing roller 13*a* and generates multiple magnetic poles around a circumferential surface of the developing roller 13*a*. The sleeve rotates about the magnet. The magnet forms multiple magnetic poles on (the sleeve of) the developing roller 13*a*, and developer G moves to be borne on the developing roller 13*a*. The developer G is a two-component developer contained in the developing device 13. The developer G includes carrier C including carrier particles and toner T including toner particles.

A main motor drives to rotate the developing roller 13*a* in a direction indicated by arrow in FIG. 2, The first conveying screw 13*b* and the second conveying screw 13*c* are disposed facing each other with the partition interposed therebetween. The first conveying screw 13*b* is rotated by a drive gear mounted at an end portion thereof, in a direction indicated by arrow in FIG. 2. The second conveying screw 13*c* is rotated by a drive gear mounted at an end portion thereof, in a direction indicated by arrow in FIG. 2. As the first conveying screw 13*b* and the second conveying screw 13*c* rotate in the respective directions in FIG. 2, the developer G stored in the developing device 13 passes an opening formed at an end portion of the partition and is circulated in the longitudinal direction of the developing device 13 (i.e., in a direction orthogonal to the drawing sheet of FIG. 2 and indicated by a dotted line arrow in FIG. 3) while being stirred and mixed with the toner T supplied from a toner supplying unit (i.e., a toner hopper 61 and a conveyance passage 62) via a toner supplying port.

The toner T is electrically charged by friction with the carrier C. Both the toner T and the carrier C are held on the developing roller 13*a*. As the developing roller 13*a* moves, the developer G held on the developing roller 13*a* comes to the doctor blade 13*d*. After having been adjusted to an appropriate amount by the doctor blade 13*d*, the developer G on the developing roller 13*a* then comes to an opposing position to the photoconductor drum 11 (i.e., a developing region).

Thereafter, the toner T of the developer G adheres to the electrostatic latent image formed on the surface of the photoconductor drum 11 in the development region. As a result, a desired toner image is formed. To be more specific, the toner T adheres to the electrostatic latent image by an electric field generated by a potential difference (i.e., a developing potential) between a latent image potential (i.e., an exposure potential) of an image area to which the laser light beam L is emitted and a developing bias (of approximately −500V) applied to the developing roller 13*a*.

Here, the toner supplying unit provided to the apparatus body 1A of the image forming apparatus 1 includes a toner container 60 and the toner hopper 61. The toner container 60 is a replaceable container. The toner hopper 61 functions as a conveying device to store and convey the toner T discharged from the toner container 60 and supply the toner T to the developing device 13. The toner container 60 is filled with new toner T of specific color according to a toner image to be formed. In addition, the toner container 60 has an inner circumferential surface with spiral projections formed thereon.

Figure 4:
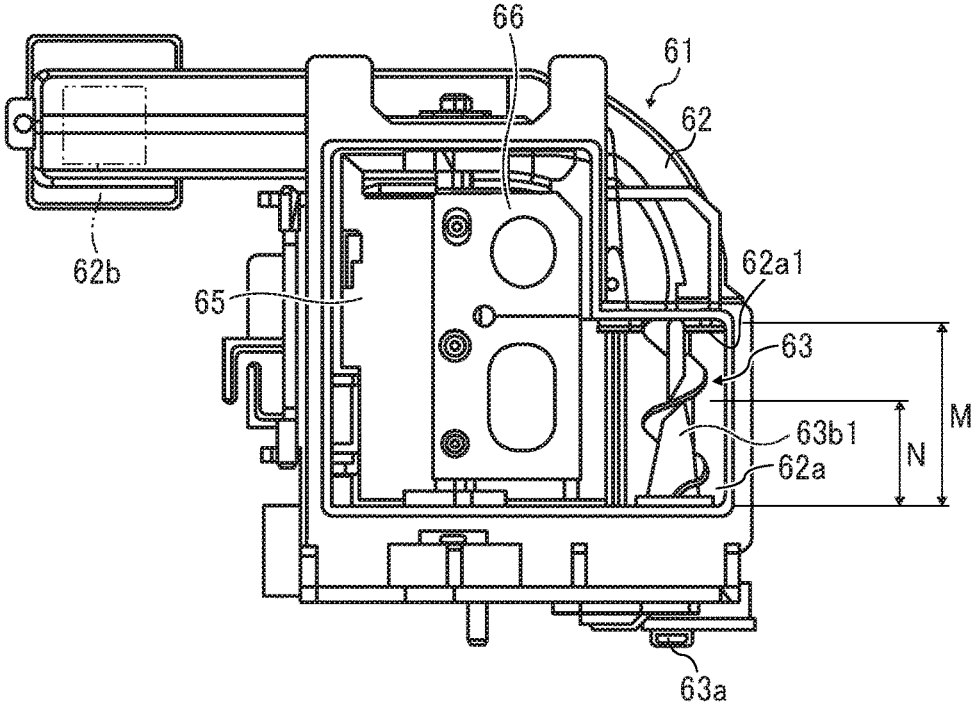
FIG. 4 is a top view illustrating the toner hopper.

FIG. 3 is a diagram illustrating the toner container 60, the toner hopper 61 and the developing device 13, viewed along a longitudinal direction thereof. FIG. 4 is a top view illustrating the toner hopper 61.

Referring to FIGS. 3 and 4, as the toner container 60 is rotated by a motor, toner is discharged via a toner outlet port of the toner container 60 to be stored in a toner receiving portion 65 of the toner hopper 61. The toner stored in the toner receiving portion 65 is stirred by a toner agitating member 66 and part of toner agitated by the toner agitating member 66 is conveyed into a conveyance passage 62 via an inlet portion 62*a*. The toner conveyed into the conveyance passage 62 is conveyed by the conveying screw 63 in the conveyance passage 62, and is discharged from an outlet portion 62*b*. The toner discharged from the outlet portion 62*b* falls by the own weight to be supplied into the developing device 13.

It is to be noted that detailed configuration and functions of the toner hopper 61 are described below.

Here, it is to be noted that, as the toner T that is supplied to the developing device 13 is consumed, the amount of the toner T stored in the toner receiving portion 65 of the toner hopper 61 reduces. According to the reduction of the amount of the toner T in the toner hopper 61, the new toner T contained in the toner container 60 is replenished appropriately to the toner hopper 61. The amount of toner in the toner hopper 61 is detected by a piezoelectric sensor disposed to the toner receiving portion 65.

Further, it is to be noted that, as the existing toner T that is stored in the developing device 13 is consumed, the new toner T contained in the toner hopper 61 is replenished appropriately to the developing device 13. Consumption of the toner T in the developing device 13 is magnetically detected by a magnetic sensor disposed at a position below the second conveying screw 13*c* of the developing device 13.

Referring to FIG. 2, the cleaning device 14 includes a cleaning blade 14*a* and a cleaning brush roller 14*b*. The cleaning blade 14*a* contacts the surface of the photoconductor drum 11 to clean the surface of the photoconductor drum 11. The cleaning brush roller 14*b* rotates in a predetermined direction while in contact with the surface of the photoconductor drum 11 to clean the surface of the photoconductor drum 11.

Referring to FIG. 2, the lubricating device 15 includes a lubricant application roller 15*a*, solid lubricant 15*b*, a compression spring 15*c*, a holder 15*d*, and a regulating blade 15*f*. The lubricant application roller 15*a* includes an elastic foam layer that slidably contacts the photoconductor drum 11 and applies lubricant onto the photoconductor drum 11. The solid lubricant 15*b* slidably contacts the lubricant application roller 15*a* (the elastic foam layer). The compression spring 15*c* functions as a biasing body that biases the solid lubricant 15*b* toward the lubricant application roller 15*a*. The holder 15*d* contains the solid lubricant 15*b* and the compression spring 15*c* therein. The regulating blade 15*f* contacts the photoconductor drum 11 and making (regulating) lubricant applied onto the photoconductor drum 11 into a thin layer.

The lubricating device 15 having the above-described configuration applies lubricant on the surface of the photoconductor drum 11, so as to reduce or restrain wear and deterioration of the photoconductor drum 11 and the cleaning blade 14*a*.

Now, a description is given of the configuration and functions of the toner hopper 61 that functions as a conveying device.

As described above, with reference to FIGS. 3 and 4, the image forming apparatus 1 according to the present embodiment includes the toner hopper 61 that functions as a conveying device that conveys toner. The toner hopper 61 (that functions as a conveying device) includes the conveying screw 63 and the conveyance passage 62.

Figure 5:
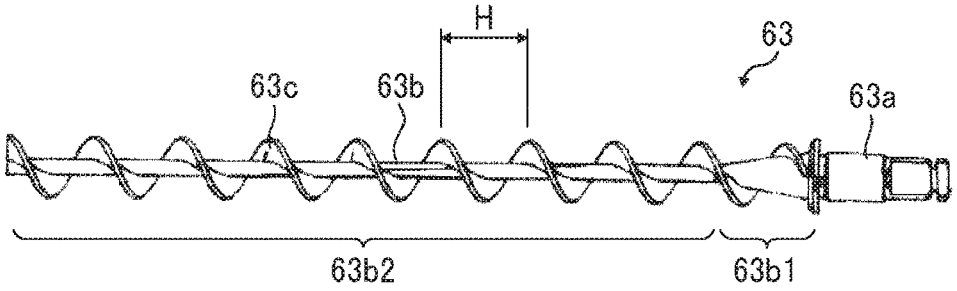
FIG. 5 is a diagram illustrating a conveyance screw alone.

Here, in the present embodiment, the conveying screw 63 includes a shaft 63*b* and a screw portion 63*c*. As illustrated in FIG. 5, the screw portion 63*c* is wound around the shaft 63*b* in a spiral. The conveying screw 63 is integrally molded from an elastic material such as elastomer. The screw portion 63*c* of the conveying screw 63 is formed at a constant screw pitch H and has a constant screw outer diameter.

The conveying screw 63 further includes a drive shaft 63*a* at one end side thereof (i.e., a position adjacent to a high rigidity portion 63*b*1). The drive shaft 63*a* has a shaft diameter greater than a shaft diameter of the shaft 63*b* (i.e., an equal diameter shaft portion 63*b*2). The drive shaft 63*a* has a part including a D-cut portion on which a drive gear 64 (see FIG. 3) is mounted and a gutter in which a retaining ring is mounted. Further, the drive shaft 63*a* is rotatably held by the housing of the toner hopper 61 via a bearing. Consequently, as a drive motor drives and inputs a driving force to the drive gear 64 mounted on the drive shaft 63*a*, the conveying screw 63 rotates in the predetermined direction.

In the present embodiment, the conveying screw 63 includes an elastic material. Therefore, when compared with a configuration provided with a conveying screw including a metallic material, the conveying screw 63 according to the present embodiment achieves a reduction in weight and cost. Further, the conveying screw 63 including an elastic material can be disposed in a curved conveyance passage.

The conveying screw 63 is provided in the conveyance passage 62. As the conveying screw 63 is driven and rotated, toner is conveyed in a predetermined conveying direction.

As illustrated in FIG. 4, the conveyance passage 62 includes straight conveyance passages and a curved conveyance passage. The straight conveyance passages are a conveyance passage extending in a vertical direction in FIG. 4 and a conveyance passage extending in a left-to-right direction (i.e., a horizontal direction) in FIG. 4. The curved conveyance passage is a conveyance passage to relay the two straight conveyance passages. Therefore, the conveying screw 63 is provided with a partially curved part thereof, so as to be disposed along the conveyance passage 62 partially having a curved portion.

Further, the conveyance passage 62 (i.e., the straight conveyance passage extending in the vertical direction in FIG. 4) has the inlet portion 62*a* at an upstream side of the conveying direction. The inlet portion 62*a* conveys toner into the inside of the conveyance passage 62. The inlet portion 62*a* is a cylindrical port having a substantially rectangular shape and opening upwardly and has an entrance opening 62*a*1 that functions as an entrance of the inlet portion 62*a*.

Further, the conveyance passage 62 (i.e., the straight conveyance passage extending in the horizontal direction in FIG. 4) has the outlet portion 62*b* at a downstream side of the conveying direction. The outlet portion 62*b* conveys toner to the outside of the conveyance passage 62. The outlet portion 62*b* opens downwardly and communicates with the toner supplying port of the developing device 13.

According to this configuration, the toner conveyed out from the outlet portion 62*b* of the conveyance passage 62 to the toner hopper 61 is conveyed by the conveying screw 63 toward the downstream side of the conveying direction, so that the toner is discharged via the outlet portion 62*b* to be supplied to the developing device 13.

Here, referring to FIG. 4, in the present embodiment, the conveying screw 63 has an exposed portion exposed through the inlet portion 62*a* in the conveyance passage 62. A portion of the exposed portion of the conveying screw 63 includes a high rigidity portion 63*b*1 that has rigidity greater than rigidity of the other portion (i.e., the equal diameter shaft portion 63*b*2) of the conveying screw 63.

Specifically, as illustrated in FIG. 5, the shaft 63*b* of the conveying screw 63 includes the equal diameter shaft portion 63*b*2 that has an identical diameter over the axial direction thereof and the high rigidity portion 63*b*1 that has modulus of rigidity higher than the equal diameter shaft portion 63*b*2. To be more specific, the high rigidity portion 63*b*1 is formed by elastic material such as elastomer, which is similar to the equal diameter shaft portion 63*b*2. Further, the high rigidity portion 63*b*1 has a shaft diameter (i.e., an outer diameter of the shaft 63*b* of the conveying screw 63 at the high rigidity portion 63*b*1) to be greater than a shaft diameter of the equal diameter shaft portion 63*b*2 (i.e., an outer diameter of the shaft 63*b* of the conveying screw 63 at a non high rigidity portion other than the high rigidity portion 63*b*1).

Further, the high rigidity portion 63*b*1 has a screw diameter of the screw portion 63*c* of the conveying screw 63 to be equal to a screw diameter of the screw portion 63*c* of the conveying screw 63 at the equal diameter shaft portion 63*b*2 (i.e., an outer diameter of the shaft 63*b* of the conveying screw 63 at a non high rigidity portion other than the high rigidity portion 63*b*1).

According to this configuration, the conveying screw 63 has an equal screw diameter of the screw portion 63*c* over the axial direction, and therefore the rigidity of the high rigidity portion 63*b*1 on the drive shaft 63*a* side is enhanced.

Then, as illustrated in FIG. 4, when the toner hopper 61 without toner therein is viewed from top, the high rigidity portion 63*b*1 in the toner hopper 61 can be seen from the inlet portion 62*a*.

Figure 6:
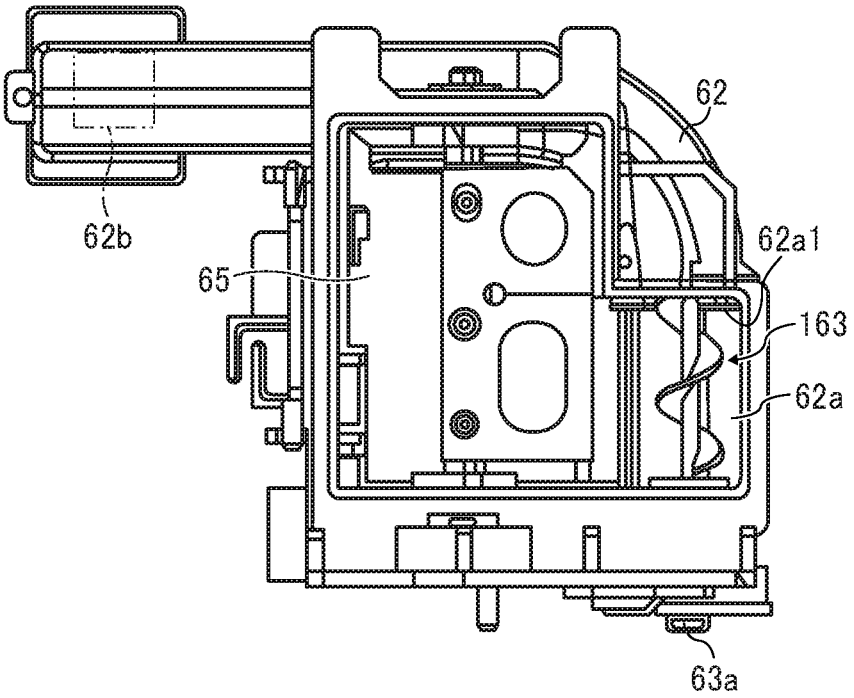
FIG. 6 is a top view illustrating a comparative toner hopper.
Figure 7:
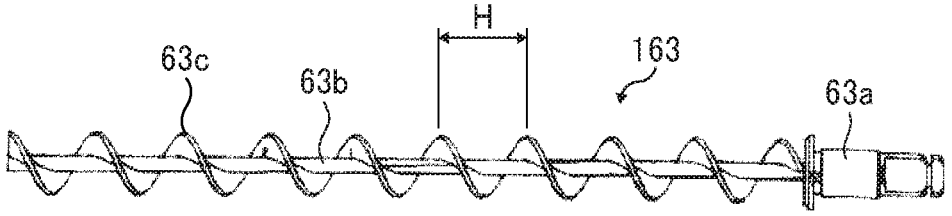
FIG. 7 is a diagram illustrating a conveyance screw provided to the comparative toner hopper of FIG. 6.

In a case in which a large amount of toner is stagnated on the downstream side of the conveyance passage 62, it is likely that a conveying screw 163 having no high rigidity portion is twisted or broken at the position of the inlet portion 62*a*, as illustrated in FIGS. 6 and 7. For these reasons, the high rigidity portion 63*b*1 is provided at a position at which the high rigidity portion 63*b*1 is exposed through the inlet portion 62*a*.

Specifically, in a case in which a large amount of toner is stagnated on the downstream side of the conveyance passage 62, the rotational resistance at the position increases, resulting in generation of a twisting force between the upstream side and the downstream side of the conveying screw 163. When such a twisting force is generated, the twisting force is not generated easily at the other position other than the position of the inlet portion 62*a* facing the conveying screw 163 because the other position is surrounded by the conveyance passage 62 (i.e., the housing of the toner hopper 61). By contrast, the twisting force is easily generated at the position of the inlet portion 62*a* facing the conveying screw 163 because the position is not surrounded by the conveyance passage 62 (i.e., the housing of the toner hopper 61). Once such a twisting force is generated, it is likely that the stress is concentrated on the position and the conveying screw 163 may come to be broken. Specifically, in the present embodiment of this disclosure, the conveying screw 63 has a curved portion. Therefore, the above-described inconvenience tends to occur easily.

By contrast, in the present embodiment of this disclosure, the conveying screw 63 has the high rigidity portion 63*b*1 at a portion at which twist or break is generated easily. Accordingly, it is not likely that the above-described inconvenience occurs easily. In addition, the high rigidity portion 63*b*1 is disposed not over the entire opening area of the inlet portion 62*a* but over part of the opening area of the inlet portion 62*a*. Therefore, no inconvenience such as a reduction in conveyance amount of toner from the inlet portion 62*a* or a reduction in the conveyance performance of toner after receiving from the inlet portion 62*a* is generated.

Here, in the present embodiment of this disclosure, as illustrated in FIG. 4, the following relation is satisfied, $$M>N,$$

where "M" represents an opening width of the inlet portion 62*a* in the conveying direction and "N" represents a length of the high rigidity portion 63*b*1 of the conveying screw 63 in the conveying direction.

According to this configuration, the effect that the conveying screw 63 is not susceptible to torsion and break is maintained and, at the same time, the inconvenience that toner is stagnated and is not conveyed via the inlet portion 62*a* easily and the inconvenience that the conveyance performance of toner is degraded after the conveyance of toner to the inlet portion 62*a* are reduced.

Specifically, in the present embodiment, the high rigidity portion 63*b*1 is disposed on the upstream side of the inlet portion 62*a* in the conveying direction. That is, the high rigidity portion 63*b*1 is disposed close to the lower end of the opening area of the inlet portion 62*a* in FIG. 4.

According to this configuration, the effect that the conveying screw 63 is not susceptible to torsion and break is maintained and, at the same time, the inconvenience that toner is stagnated and is not conveyed via the inlet portion 62*a* easily and the inconvenience that the conveyance performance of toner is degraded after the conveyance of toner to the inlet portion 62*a* are reduced.

Further, in the present embodiment of this disclosure, as illustrated in FIG. 4, the following relation is satisfied, $$M>N+\tfrac{1}{4}\times H,$$

where "M" represents the opening width of the inlet portion 62*a* in the conveying direction, "N" represents the length of the high rigidity portion 63*b*1 of the conveying screw 63 in the conveying direction, and "H" represents a screw pitch of the conveying screw 63.

Further, the screw diameter of the screw portion 63*c* of the conveying screw 63 at the high rigidity portion 63*b*1 is equal to the screw diameter of the screw portion 63*c* of the conveying screw 63 at the equal diameter shaft portion 63*b*2. However, since the shaft diameter of the high rigidity portion 63*b*1 is greater than the shaft diameter of the equal diameter shaft portion 63b2, the screw portion 63c of the high rigidity portion 63b1 is made smaller than the screw portion 63c of the equal diameter shaft portion 63b2. Therefore, in a case in which the length N is set greater to some extent to satisfy the above-described relation of M>N, it is likely that the conveyance performance of toner after conveyed from the inlet portion 62a is not ensured. Accordingly, by having the configuration to satisfy the above-described relation of M>N+¼×H based on test results, the conveyance performance of toner can be ensured.

Specifically, in the present embodiment, the outer diameter of the shaft 63b of the conveying screw 63 at the high rigidity portion 63b1 gradually decreases toward a downstream side in the conveying direction. Further, the outer diameter of the shaft 63b of the conveying screw 63 at the high rigidity portion 63b1 is equal to the outer diameter of the shaft 63b of the conveying screw 63 at the non high rigidity portion (i.e., the equal diameter shaft portion 63b2) at the downstream end of the conveying screw 63 in the conveying direction.

Specifically, further referring to FIG. 5, the shaft diameter of the conveying screw 63 at the high rigidity portion 63b1 at the upstream side end is substantially equal to the shaft diameter of the drive shaft 63a. In addition, the shaft diameter of the conveying screw 63 at the high rigidity portion 63b1 at the downstream side end is substantially equal to the shaft diameter of the conveying screw 63 at the equal diameter shaft portion 63b2. Consequently, the high rigidity portion 63b1 has a substantially conical frustum shape having the shaft diameter gradually decreases from the upstream side end toward the downstream side end.

According to this configuration, the toner conveyed from the inlet portion 62a of the conveyance passage 62 can be conveyed smoothly with sufficient conveyance performance.

As described above, the toner hopper 61 (the conveying device) according to the present embodiment includes the conveying screw 63 formed by an elastic material therein and the conveyance passage 62 in which the inlet portion 62a is formed at the upstream side in the conveying direction. In addition, the conveying screw 63 includes the high rigidity portion 63b1 as a part exposed from the inlet portion 62a in the inside the conveyance passage 62. The rigidity of the high rigidity portion 63b1 is greater than the rigidity of the other portion (i.e., the equal diameter shaft portion 63b2).

According to this configuration, the conveying screw 63 formed by an elastic material is not twisted or broken easily.

It is to be noted that, in the present embodiment, this disclosure is applicable to the high rigidity portion 63b1 having the shaft diameter greater than the equal diameter shaft portion 63b2. However, application of this disclosure is not limited thereto. For example, the high rigidity portion 63b1 may be formed by an elastic material having rigidity greater than the equal diameter shaft portion 63b2.

Further, even in the above-described case, the above-described configuration can achieve the same effect as each configuration of the conveying device according to the present embodiment.

Further, in the present embodiment, this disclosure is applied to the conveying device to convey the toner T (i.e., the toner hopper 61). However, application of this disclosure is not limited thereto. For example, this disclosure is applicable to a conveying device (including the developing device 13) that conveys the developer G including the toner T and the carrier C (i.e., a two-component developer), a conveying device (i.e., a collecting device) that conveys toner collected by the cleaning device 14 (e.g., waste toner and recycled toner), and a conveying device that conveys toner and developer.

Further, even in the above-described case, the above-described configuration can achieve the same effect as each configuration of the conveying device according to the present embodiment.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A conveying device comprising:

a conveying body having an elastic material and configured to convey one of toner and developer; and a conveyance passage, including the conveying body therein, to convey the one of toner and developer in a conveying direction as the conveying body rotates, the conveying passage including an inlet portion, formed at an upstream side of the conveyance passage, and configured to pass the one of toner and developer into the conveyance passage, the conveying body including an exposed portion, exposed through the inlet portion and exposed inside the conveyance passage, and a portion of the exposed portion of the conveying body including a high rigidity portion having rigidity relatively greater than a rigidity of a non-high rigidity portion of the conveying body, wherein M represents an opening width of the inlet portion in the conveying direction and N represents a length of the high rigidity portion of the conveying body in the conveying direction, and wherein M>N.

2. The conveying device according to claim 1, wherein the high rigidity portion is disposed at an upstream side of the inlet portion in the conveying direction.

3. The conveying device according to claim 1, wherein the conveying body is a conveying screw.

4. The conveying device according to claim 3, wherein M represents an opening width of the inlet portion in the conveying direction, N represents a length of the high rigidity portion of the conveying screw in the conveying direction, and H represents a screw pitch of the conveying screw, and wherein M>N+¼×H.

5. The conveying device according to claim 3, wherein the conveying screw includes a screw portion and a shaft around which the screw portion is wound in a spiral, wherein an outer diameter of the shaft of the conveying screw at the high rigidity portion is relatively greater than an outer diameter of the shaft of the conveying screw at the non-high rigidity portion, and wherein a screw diameter of the screw portion of the conveying screw at the high rigidity portion is equal to a screw diameter of the screw portion of the conveying screw at the non-high rigidity portion.

6. The conveying device according to claim 5, wherein the outer diameter of the shaft of the conveying screw at the high rigidity portion gradually decreases toward an downstream side in the conveying direction, and wherein the outer diameter of the shaft of the conveying screw at the high rigidity portion is equal to the outer diameter of the shaft of the conveying screw at the non-high rigidity portion at a downstream end of the conveying screw in the conveying direction.

7. The conveying device according to claim 1, wherein the conveying body includes a drive shaft adjacent to the high rigidity portion and rotatably held by a housing of the conveying device via a bearing and, a drive gear being mounted on the drive shaft, wherein the conveyance passage includes a straight conveyance passage and a curved conveyance passage and wherein the conveyance passage includes an outlet portion configured to pass the one of toner and developer, and wherein the inlet portion is formed in the straight conveyance passage.

8. An image forming apparatus comprising the conveying device according to claim 1.

9. A conveying device comprising:

a conveying screw having an elastic material and configured to convey one of toner and developer;

a conveyance passage including the conveying screw therein, to convey the one of toner and developer in a conveying direction as the conveying screw rotates, the conveying passage including an inlet portion, formed at an upstream side of the conveyance passage, and configured to pass the one of toner and developer into the conveyance passage, the conveying screw including a screw portion and a shaft around which the screw portion is wound in a spiral, and including a first shaft portion and a second shaft portion, an outer diameter of the first shaft portion of the conveying screw being relatively greater than an outer diameter of the second shaft portion of the conveying screw, and a screw diameter of the screw portion of the first shaft portion of the conveying screw being equal to a screw diameter of the second shaft portion of the conveying screw, wherein M represents an opening width of the inlet portion in the conveying direction, N represents a length of the first shaft portion of the conveying screw in the conveying direction, and H represents a screw pitch of the conveying screw, and wherein $M>N+\frac{1}{4}\times H$.

10. The conveying device according to claim 9, wherein the outer diameter of the first shaft portion of the conveying screw gradually decreases toward an downstream side in the conveying direction, and wherein the outer diameter of the first shaft portion of the conveying screw is equal to the outer diameter of the second shaft portion of the conveying screw at a downstream end of the conveying screw in the conveying direction.

11. The conveying device according to claim 9, wherein the conveying screw includes a drive shaft adjacent to the first shaft portion and rotatably held by a housing of the conveying device via a bearing, a drive gear being mounted on the drive shaft, wherein the conveyance passage includes a straight conveyance passage and a curved conveyance passage and wherein the conveyance passage includes an outlet portion configured to pass the one of toner and developer, and wherein the inlet portion is formed in the straight conveyance passage.

12. An image forming apparatus comprising the conveying device according to claim 9.

13. The conveying device of claim 9, wherein M represents an opening width of the inlet portion in the conveying direction and N represents a length of the first shaft portion of the conveying screw in the conveying direction, and wherein $M>N$.

14. An image forming apparatus comprising the conveying device according to claim 13.

15. A conveying device comprising:

a conveying screw having an elastic material and configured to convey one of toner and developer; and a conveyance passage, including the conveying screw therein, to convey the one of toner and developer in a conveying direction as the conveying screw rotates, the conveying passage including an inlet portion, formed at an upstream side of the conveyance passage, and configured to pass the one of toner and developer into the conveyance passage, the conveying screw including an exposed portion, exposed through the inlet portion and exposed inside the conveyance passage, and a portion of the exposed portion of the conveying screw including a high rigidity portion having rigidity relatively greater than a rigidity of a non-high rigidity portion of the conveying screw, wherein M represents an opening width of the inlet portion in the conveying direction, N represents a length of the high rigidity portion of the conveying screw in the conveying direction, and H represents a screw pitch of the conveying screw, and wherein $M>N+\frac{1}{4}\times H$.

16. The conveying device according to claim 15, wherein the conveying screw includes a screw portion and a shaft around which the screw portion is wound in a spiral, wherein an outer diameter of the shaft of the conveying screw at the high rigidity portion is relatively greater than an outer diameter of the shaft of the conveying screw at the non-high rigidity portion, and wherein a screw diameter of the screw portion of the conveying screw at the high rigidity portion is equal to a screw diameter of the screw portion of the conveying screw at the non-high rigidity portion.

17. The conveying device according to claim 16, wherein the outer diameter of the shaft of the conveying screw at the high rigidity portion gradually decreases toward an downstream side in the conveying direction, and wherein the outer diameter of the shaft of the conveying screw at the high rigidity portion is equal to the outer diameter of the shaft of the conveying screw at the non-high rigidity portion at a downstream end of the conveying screw in the conveying direction.

* * * * *